US005981928A

United States Patent [19]

Lee

[11] Patent Number: 5,981,928

[45] Date of Patent: Nov. 9, 1999

[54] MICROWAVE DISPERSING APPARATUS OF MICROWAVE OVEN

[75] Inventor: Gye-Hong Lee, Pyungtaek, Rep. of Korea

[73] Assignee: Samsung Electronics Co., Ltd., Suwon, Rep. of Korea

[21] Appl. No.: 09/114,882

[22] Filed: Jul. 14, 1998

[30] Foreign Application Priority Data

Sep. 23, 1997 [KR] Rep. of Korea ..... 97-48340

[51] Int. Cl.[6] ..... H05B 6/72

[52] U.S. Cl. ..... 219/749

[58] Field of Search ..... 219/749, 751, 219/754, 748

[56] References Cited

U.S. PATENT DOCUMENTS

| | | | |
|---|---|---|---|
| 3,364,332 | 1/1968 | Reftmark et al. | 219/751 |
| 3,521,019 | 7/1970 | White et al. | 219/751 |
| 4,173,716 | 11/1979 | Takahashi et al. | 219/751 |
| 4,337,384 | 6/1982 | Tanaka et al. | 219/754 |
| 4,458,126 | 7/1984 | Dills et al. | 219/754 |

FOREIGN PATENT DOCUMENTS 60-32796 3/1985 Japan .

*Primary Examiner*—Teresa Walberg
*Assistant Examiner*—Jeffrey Pwu
*Attorney, Agent, or Firm*—Burns, Doane, Swecker & Mathis, L.L.P.

[57] ABSTRACT

A microwave dispersing apparatus of a microwave oven having a dispersing unit for evenly dispersing into a cooking chamber through first and second waveguides the microwaves generated by oscillation of a magnetron, the apparatus comprising: a rotary motor mounted on a first waveguide; first and second pulleys installed at the first and second waveguides for being rotated along with a driving rotary motor; a belt positioned between the first and second pulleys for enabling the two pulleys to be simultaneously rotated; first and second feeders disposed for being subsequently rotated by the rotating first and second pulleys; and first and second rotary antennas rotatively installed for evenly dispersing microwaves to the cooking chamber through the first and second waveguides as the antennas are eccentrically rotated by the power of the first and second feeders.

4 Claims, 5 Drawing Sheets

MICROWAVE DISPERSING APPARATUS OF MICROWAVE OVEN

BACKGROUND OF THE INVENTION

1. Field of the Invention

The present invention relates to a microwave dispersing apparatus of a microwave oven, and more particularly to a microwave radiating apparatus of a microwave oven which evenly heats and cooks foodstuff in a cooking (heating) chamber by rotating rotary antennas to evenly disperse the microwaves (high frequency waves or electric waves) generated by oscillation of a magnetron.

2. Description of the Prior Art

A microwave oven, in accordance with a first embodiment of the prior art in FIG. 1, includes a housing(14) dividing the cooking chamber(12) in a main body(10) forming an external appearance and a turntable motor(16) disposed at a bottom of the housing(14) for being driven by power generated from a power source (not shown).

In addition, it also includes a coupler(20) installed at a turntable motor shaft(18) of the turntable motor(16) for being rotated by the rotating turntable motor, a roller member(22) for being rotated along with the coupler(20) and a releaseable turntable(24) for placing foodstuff thereon.

There are also provided a waveguide(26) welded on one side of the housing(14), a high voltage generator(28) installed on the other side of the housing(14) for generating a high voltage with power supplied from the power source and a magnetron(30) disposed at one end of the waveguide (26) for generating microwaves by the high voltage power from the high voltage generator(28).

A microwave oven in FIG. 2, in accordance with a second embodiment of the prior art, includes first and second waveguides(42, 44) welded at external upper ends of a housing(40) at a predetermined interval, first and second rotary motors(48, 50) mounted with a motor bracket(46) on the first and second waveguides(42, 44) for being driven by power and non-metallic motor shafts(52, 54) disposed under the first and second rotary motors(48, 50) for being respectively penetrated through the first and second waveguides (42, 44).

The microwave also includes first and second metallic feeders(56, 58) respectively coupled for being rotated by power from the first and the second rotary motors(48, 50), first and second metallic rotary antennas(62, 64) disposed at ends of the first and second feeders(56, 58) for evenly dispersing the microwaves from the first and second waveguides(42, 44) into the cooking chamber(60) and first and second feeder brackets(66, 68) disposed at openings of the first and second waveguides(42, 44) for closed engaging the first and second motor shafts(52, 54) and for supporting the rotation thereof.

Combining parts between the first and second motor shafts(52, 54) and the first and second feeders(56, 58) are formed in multi-angular shapes for preventing from racing when they are assembled. The same applies to the first and second feeders(56, 58) and the first and second rotary antennas(62, 64).

The first and second feeders(56, 58) are formed with their middle portion tapering-off for being supported by the first and second feeder brackets(66, 68) for rotation, with their upper portion being fastened in the first and second waveguides(42, 44) to the first and second motor shafts(52, 54) and with their lower portion being connected in the cooking chamber(60) to the first and second rotary antennas (62, 64).

However, there is a problem in the first embodiment of the conventional microwave oven in that the microwaves radiated by the waveguide(26) are not evenly dispersed all over the cooking chamber(12) but concentrated on the foodstuff placed in the cooking chamber(12), thereby resulting in an ineffective cooking.

In addition, there is another problem in the second embodiment of the conventional microwave oven in that, in spite of the microwave dispersing apparatus including first and second rotary motors(48, 50), first and second feeders (56, 58) and first and second rotary antennas(62, 64) for evenly dispersing microwaves through the first and second waveguides(42, 44) into the cooking chamber, the first and second rotary motors(48, 50) are needed for driving the first and second rotary antennas(62, 64), thereby increasing manufacturing cost of the product and reducing job efficiency.

SUMMARY OF THE INVENTION

The present invention is presented to solve the aforementioned problems and it is an object of the present invention to provide a microwave dispersing apparatus of a microwave oven which includes one rotary motor for rotating two feeders and rotary antennas for efficiency of even radiation, for reduction of manufacturing cost and for improvement of job efficiency.

In order to achieve the object of the present invention, there is provided a microwave dispersing apparatus of a microwave oven having dispersing means for evenly dispersing through first and second waveguides into a cooking chamber the microwaves generated by oscillation of a magnetron, the apparatus comprising:

a rotary motor mounted on a first waveguide;

first and second pulleys installed at the first and second waveguides for being rotated along with a driving rotary motor;

a belt positioned between the first and second pulleys for enabling the two pulleys to be simultaneously rotated;

first and second feeders disposed for being subsequently rotated by the rotating first and second pulleys; and first and second rotary antennas rotatively installed for evenly dispersing microwaves to the cooking chamber through the first and second waveguides as the antennas are eccentrically rotated by the power of the first and second feeders.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Figure 1:
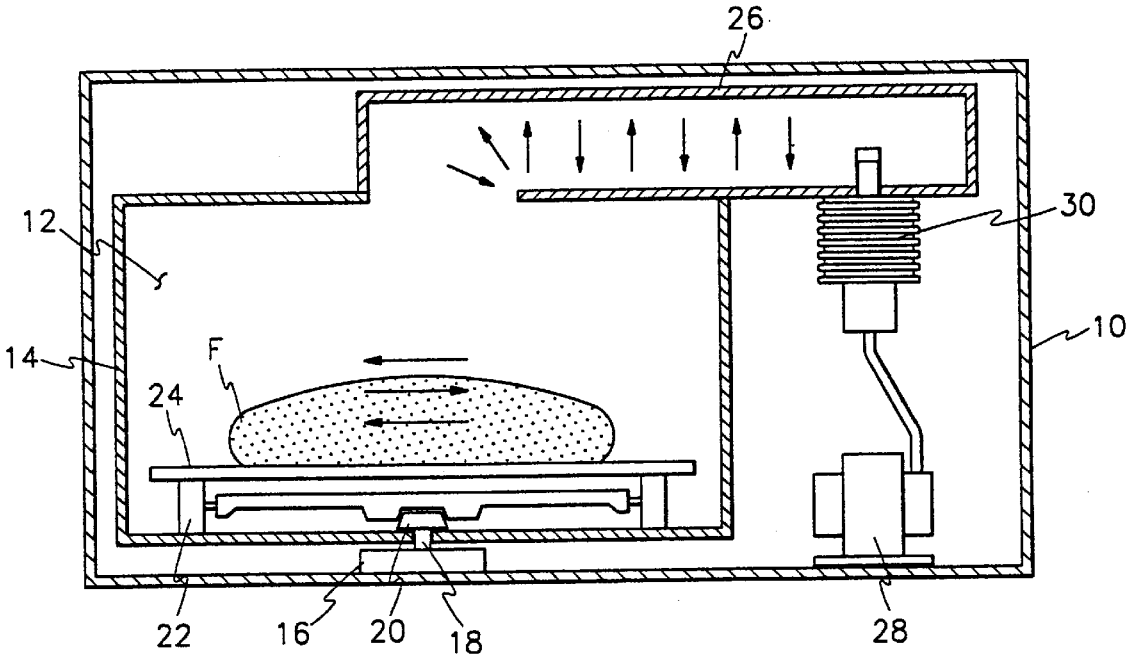
FIG. 1 (Prior Art)
FIG. 1 is a longitudinal sectional view of a microwave oven in accordance with a first embodiment of the prior art.
Figure 2:
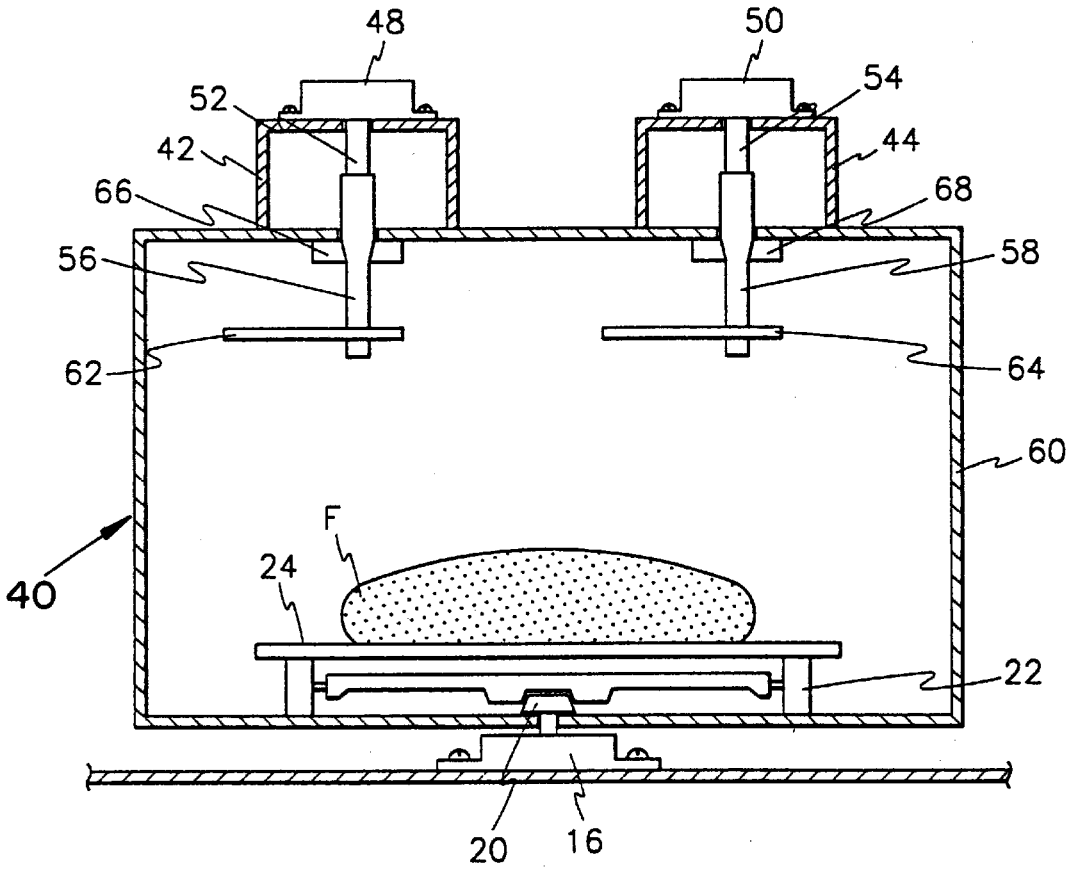
FIG. 2 (Prior art)
FIG. 2 is a longitudinal sectional view of a microwave oven in accordance with a second embodiment of the prior art.

A preferred embodiment of the present invention is described in detail with reference to the accompanying drawings. Throughout the drawings, like reference numerals and symbols are used for designation of like or equivalent parts or portions for simplicity of illustration and explanation, and redundant references will be omitted.

Figure 3:
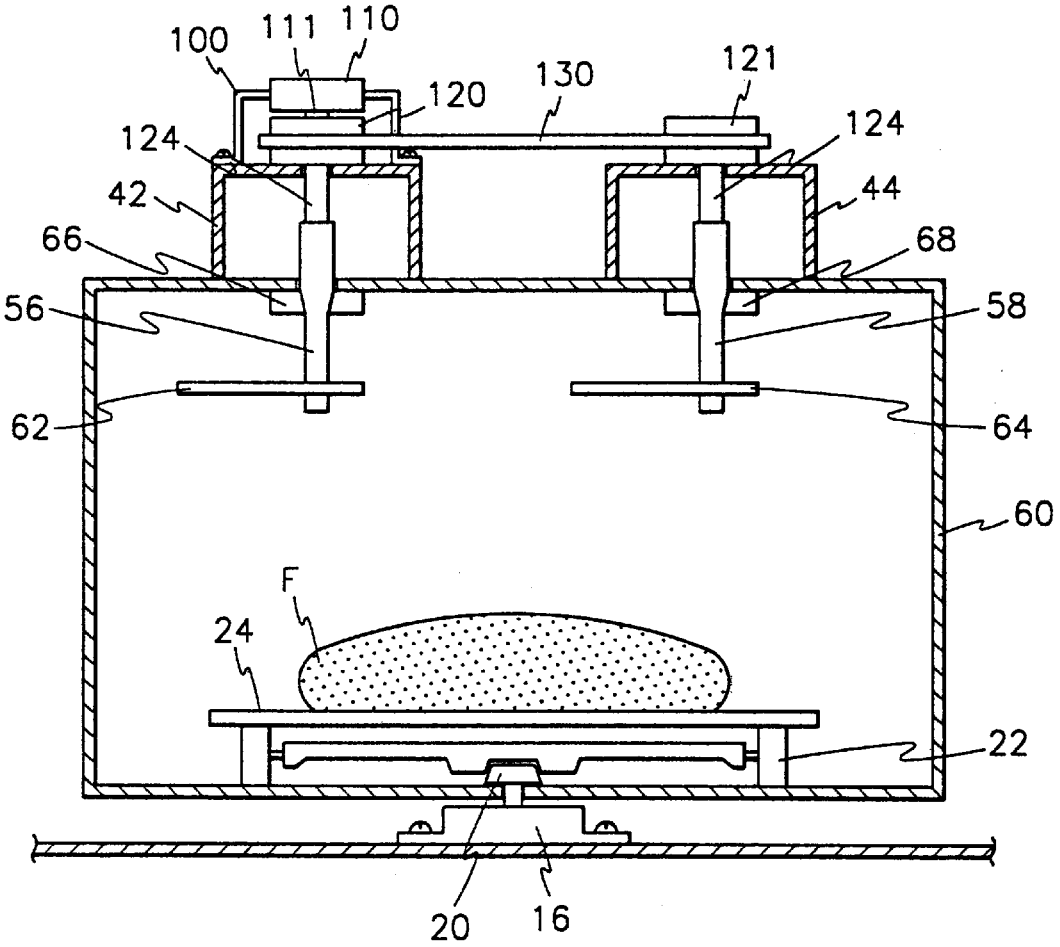
FIG. 3 is a longitudinal sectional view of a microwave oven in accordance with a first embodiment of the present invention.
Figure 4:
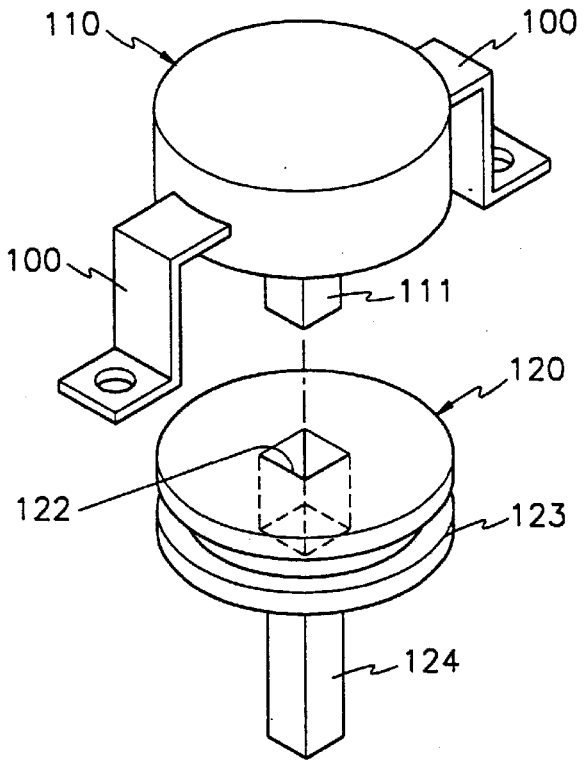
FIG. 4 is an analytical perspective view of a rotary motor and a first pulley in accordance with a first embodiment of the present invention.
Figure 5:
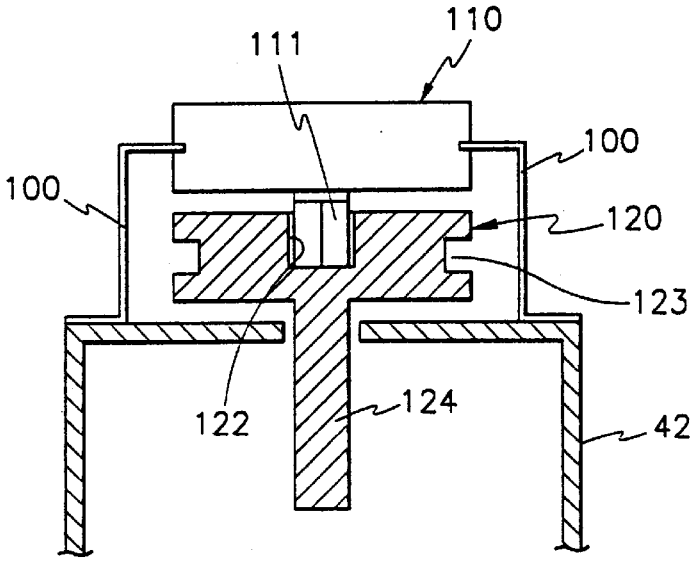
FIG. 5 is a longitudinal sectional view for illustrating an assembled state of FIG. 4.

An dispersing apparatus of the present invention, as shown in FIGS. 3, 4 and 5, includes a rotary motor(110) mounted on a first waveguide(42); a first pulley(120) installed at the first waveguide(42) for being rotated along with the driving rotary motor(110) and a second pulley disposed on a second waveguide(44) for being rotated by power of the first pulley(120) which conveyed by a belt (130). At this time, a multi-angular groove(122) is formed at a predetermined depth at the middle portion of the upper surface of the first pulley(120) for receiving a shaft(111) of the rotary motor(110) from racing.

A belt connecting groove(123) is formed around the middle portion of the first and second pulleys(120, 121) at a predetermined depth for getting connected each other by the belt(130). A multi-angular pulley shaft(124) (e.g., of rectangular cross section) is protruded at a lower middle portion of the first and second pulleys(120, 121) at a predetermined length by penetrating the first and second waveguides(42, 44) for enabling the pulleys(120, 121) to be connected, without racing, to the first and second feeders(56, 58).

Next, operational effects of the present invention are described in detail. If foodstuff (F) is placed on the turntable (24) in the cooking chamber(60), if a cooking function is selected with key input means(not shown), and if an operation key is turned on for a start, a turntable motor(16) is driven by power supplied from power means (not shown).

At this time, a coupler(20) is rotated by the driven turntable motor(16) to continuously drive a roller member (22) for rotating the turntable(24) mounted on the coupler (20).

On the other hand, microwaves generated at two oscillating magnetrons (not shown) are guided to proceed through the first and second waveguides(42, 44) and evenly dispersed into the cooking chamber(60) through an opening (not shown). Therefore, the foodstuff (F) on the rotating turntable(24) is heated and cooked by the evenly dispersed microwaves.

If the rotary motor(110) installed on the first waveguide (42) is driven by the power from the power source, the motor shaft(111) is rotated to drive the first pulley(120) disposed between the first waveguide(42) and the rotary motor(110). At this time, the first pulley(120) rotates the second pulley (121) mounted on the second waveguide(44) by way of the belt(130).

The first and second pulleys(120, 121) simultaneously rotate the first and second feeders(56, 58) vertically combined to the pulley shaft(124) on the lower portion thereof. The feeders(56, 58) are rotated by the first and second feeder brackets(66, 68) disposed at the opening of the first and second waveguides to eccentrically drive the first and second rotary antennas(62, 68) installed at the opening of the first and second waveguides(42, 44).

At this time, the first and second rotary antennas(62, 64) are eccentrically rotated to evenly disperse the microwaves radiated through the openings of the first and second waveguides(42, 44) into the interior of the cooking chamber (60) and to evenly radiate the microwaves to the foodstuff for being transmitted, absorbed or reflected. As soon as the microwaves reach the foodstuff (F), the microwaves are transformed into heat energy by the molecular friction for heating and cooking foodstuff.

Figure 6:
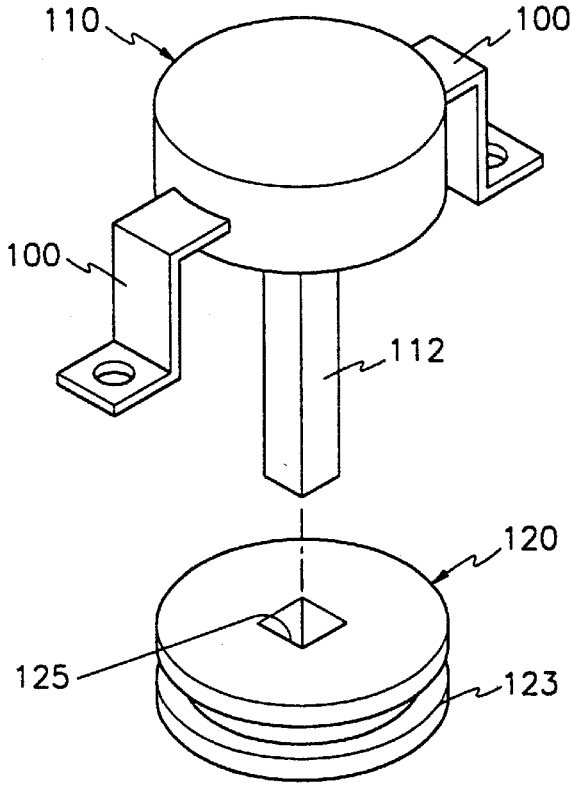
FIG. 6 is an analytical perspective view for illustrating a rotary motor and a first pulley in accordance with a second embodiment of the present invention.
Figure 7:
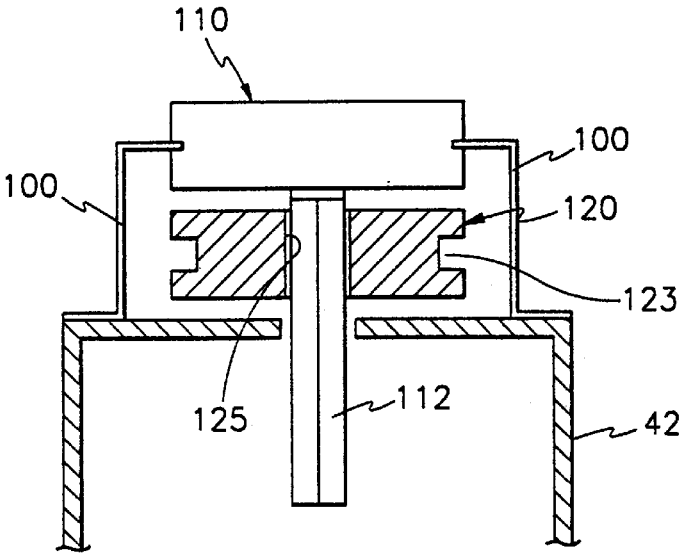
FIG. 7 is a longitudinal sectional view for illustrating an assembled state of FIG. 6.

Even if the microwave dispersing apparatus of the microwave oven thus described includes the motor shaft(111) protruded a little under the rotary motor(110) for being inserted into the multi-angular groove(122) formed at a predetermined depth on the first pulley(120) to refrain from racing and the pulley shaft(124) protruded deep under the first pulley(120) for being assembled to the upper portion of the first feeder(56) to refrain from racing, the actual scope of the present invention is not limited to the present embodiments. It is evident that variations of the microwave oven in FIGS. 6 and 7 having the motor shaft(112) inserted deep under the rotary motor(110) and the multi-angular holes (125) formed at the first pulley(120) for enabling the motor shaft(112) to be directly assembled to the first feeder(56) are included in the scope of the present invention.

What is claimed is:

1. A microwave dispersing apparatus of a microwave oven having dispersing means for evenly dispersing into a cooking chamber through first and second waveguides the microwaves generated by oscillation of a magnetron, the apparatus comprising:

a rotary motor mounted on the first waveguide and including a drive shaft having a non-circular cross section;

first and second pulleys installed at the first and second waveguides respectively, the first pulley being coaxial with and coupled to the drive shaft for being rotated thereby when the drive shaft is rotated by the rotary motor;

a belt positioned between the first and second pulleys for enabling the two pulleys to be simultaneously rotated;

first and second feeders connected to the first and second pulleys respectively, to be rotated therewith; and first and second rotary antennas disposed in the cooking chamber and connected to the first and second feeders, respectively, to be driven thereby.

2. The apparatus, as defined in claim 1, wherein the first pulley is formed at an upper center thereof with a groove having a predetermined depth, the groove being of non-circular cross section corresponding to the cross-section of the drive shaft and receiving the drive shaft.

3. The apparatus, as defined in claim 1, wherein each of the first and second pulleys comprises:

a belt connecting grooves formed around the middle portion of the respective one of the first and second pulleys at a predetermined depth for receiving the belt; and a pulley shaft integrally and centrally depending downwardly therefrom and fixedly coupled to the first and second feeders.

4. The apparatus, as defined in claim 1, wherein the first pulley is centrally formed with a through-hole of non-circular cross section for enabling the shaft of the rotary motor to penetrate therethrough for a direct assembly to the first feeder.

* * * * *